United States Patent [19]

De Luca

[11] Patent Number: 4,635,980

[45] Date of Patent: Jan. 13, 1987

[54] LOCK ASSEMBLY FOR METALLIC COVERS

[75] Inventor: Paul V. De Luca, Plandome Manor, N.Y.

[73] Assignee: Porta Systems Corp., Syosset, N.Y.

[21] Appl. No.: 800,269

[22] Filed: Nov. 21, 1985

[51] Int. Cl.[4] ..... E05C 19/08

[52] U.S. Cl. ..... 292/281; 292/109; 292/114

[58] Field of Search ..... 292/281, 282, 283, 284, 292/285, 286, 287, 115, 109, 114, 107, 209, 206, 105

[56] References Cited

U.S. PATENT DOCUMENTS 414,590 11/1889 Rubin ..... 292/209 X
455,149 6/1891 Ayers ..... 292/109 X
2,731,238 1/1956 French et al. ..... 292/114 X
4,113,291 9/1978 Cameron ..... 292/281 X

FOREIGN PATENT DOCUMENTS 619505 9/1980 Switzerland ..... 292/209

*Primary Examiner*—William F. Pate, III
*Assistant Examiner*—Creighton Smith
*Attorney, Agent, or Firm*—Charles E. Temko

[57] ABSTRACT

A lock assembly for securing covers for electrical housings, particularly in the telephone industry, operable by a standard tool normally carried by telephone service personnel, thereby eliminating the necessity of carrying additional keys, as well as eliminating the need for conventional padlocks.

2 Claims, 2 Drawing Figures

LOCK ASSEMBLY FOR METALLIC COVERS

BACKGROUND OF THE INVENTION

This invention relates generally to the field of telephony, and more particularly to an improved locking device employed to secure the covers on housings of various types, normally used to enclose the terminals of cables, connector blocks, protector devices and the like. While not limited to such usage, the invention has particular application in the effecting of a relatively tamper-proof closure for covers which are normally secured by a padlock or similar locking device.

While many housings are designed for use in conjunction with a padlock, the use of such padlock has accompanying inconveniences, such as the necessity of providing service people with keys to open the padlock which are subject to being lost, and possess the added disadvantage that individual keys may be used to open a relatively limited number of such padlocks. Further, padlocks employing spring-pressed tumblers are relatively expensive, and where exposed to the elements, often become inoperative due to internal rusting and the like.

SUMMARY OF THE INVENTION

Briefly stated, the invention contemplates the provision of a lock assembly which is secured in position by a hex head bolt, the bolt being shielded from engagement by conventional wrenches, but readily accessible to a serviceman having a proper tool for engaging the head of the bolt. The bolt engages one end of a hook-like locking member, an opposite of which engages a bracket on a housing carrying the cover in a manner to replace the hasp of a conventional padlock. A projection is provided on the outer surface of the cover which is normally positioned in such a manner as to prevent the hook member from being dislodged by an impacting tool unless the bolt has been first loosened. Most conveniently, the hook-like member is formed as a metallic stamping at a cost which is a fraction of the cost of the replaced padlock. The device is held in position on the cover by a field-installable retaining nut which engages the threaded shank of the bolt on an inner surface of the cover.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
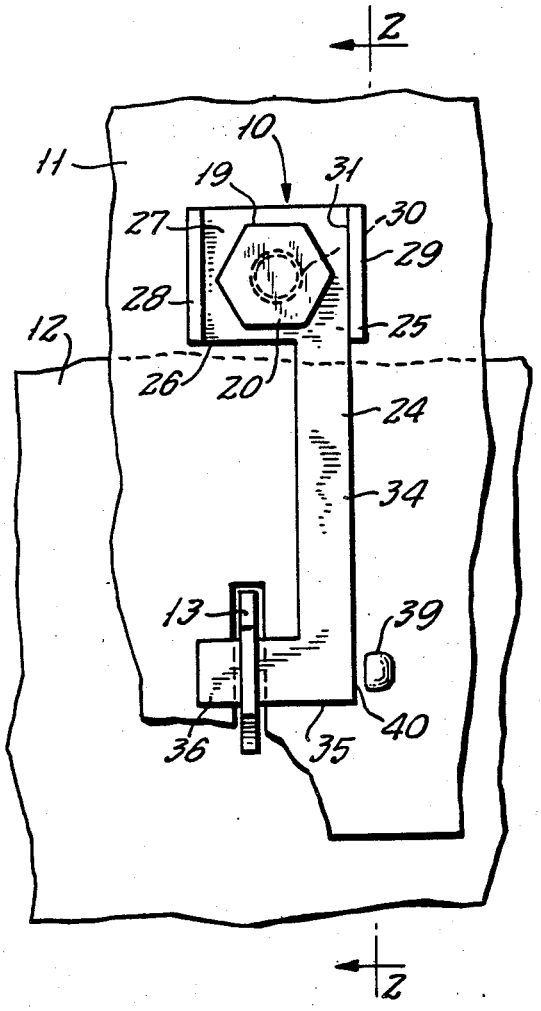
FIG. 1 is a fragmentary side elevational view of an embodiment of the invention.
Figure 2:
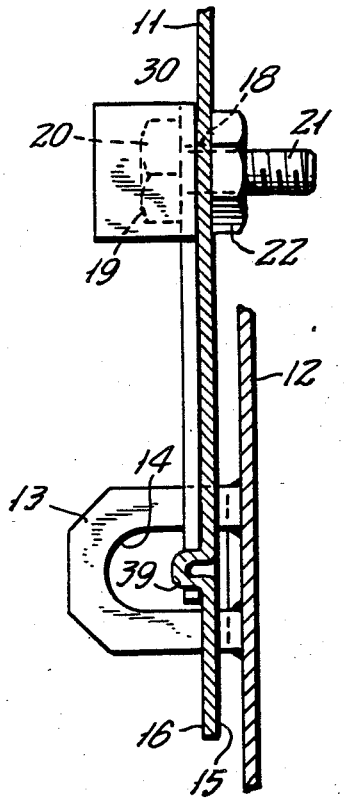
FIG. 2 is a fragmentary sectional view as seen from the Plane 2—2 in FIG. 1.

In accordance with the invention, the device, generally indicated by reference character 10 is employed in connection with a known lockable cover member 11 and housing 12 commonly used for enclosing telephone and electrical components. The housing 12 includes a projecting bracket 13 forming a loop opening 14 normally engaged by a padlock (not shown). The cover member 11 is normally of planar configuration, and is bounded by an inner surface 15 and an outer surface 16. In accordance with the invention, the cover member 11 is provided with a through opening 18 accommodating a polygonal head screw or bolt 19 including a head portion 20 and a threaded shank 21 maintained in position by a correspondingly threaded nut 22.

Maintained in position by the bolt 19 is a hook element 24, most conveniently formed as a metallic stamping, the configuration of which is best illustrated in FIG. 1. The element 24 includes a first end 25 forming a rectangular terminal 26 including a base wall 27 and first and second flanges 28 and 29 which extend laterally from the plane of the base wall 27 to form a partially enclosed channel therebetween. A through bore 30 accommodates the bolt 19 and is adapted to be placed in congruent relation relative to the opening 18. The channel 31 between the the flanges 28 and 29 is of effective width only slightly greater than the diameter of the head portion 20, whereby the portion 20 is engageable only by resort to a socket tool (not shown) of very thin walled configuration normally carried by telephone company personnel for other purposes.

In co-planar relation with the base wall 27 is a elongated shank 34 terminating at a second end 35 including a laterally-extending portion 36 in the plane of the shank 34 which is selectively positionable in a lock opening 37 and the bracket 13 to form the mechanical equivalent of a padlock hasp.

FIG. 1 illustrates the device in normally locked condition. To obtain access to the interior of the housing 12, a serviceman employs the above-mentioned tool to loosen the bolt 19 to a degree sufficient to permit angular rotation of the second end 35 in a counter-clockwise direction as seen in FIG. 1 until the bracket 13 is cleared.

The hook element 24 in disengaged condition remains attached to the cover member 11 until the cover member 11 is again closed and the hook element 24 repositioned.

To prevent unauthorized dislodgment of the hook element 24, for example, by placing the end of a screwdriver against an edge of the second end 35, the cover member 11 is provided with a dimple or similar projection which extends outwardly from the outer surface 16 to abut an opposed edge 40 of the hook element. While the projection 39 provides no obstacle to rotation of the hook element 24 when the bolt 19 is loosened, the bolt does maintain the hook element in a plane passing through the projection 39 when tightened, where it will lie at the time of unauthorized tampering.

It may thus be seen that I have invented a novel and highly useful substitute for a conventional padlock, which may be manufactured at a fraction of the cost of a padlock, and which eliminates the need for a service personnel to carry one or more keys normally required to open a padlock. The entire construction requires only a threaded nut and bolt and a simple metallic stamping to be used in conjunction with a tool normally carried by telephone company service personnel.

I wish it to be understood that I do not consider the invention limited to the precise details of structure shown and set forth in this specification, for obvious modifications will occur to those skilled in the art to which the invention pertains.

I claim:

1. An improved lock assembly for use in securing a cover to a housing for telephone apparatus and the like, the housing having a projecting bracket forming a loop opening normally engaged by a padlock hasp or similar locking device, the cover having a slotted opening surrounding said bracket; said lock assembly comprising: a hook element of generally elongated configuration having a planar base member forming first and second ends; said first end having a through bore therein and a pair of flanges laterally extending from the plane of said base member on either side of said bore to form a channel therebetween; said second end having a laterally extending projection in the plane of said base member selectively positionable in said loop opening; a threaded bolt having a polygonal head positioned within said channel, and a threaded shank penetrating said bore in said first end and a through bore in said cover, and a nut threadedly engaging said threaded shank; said polygonal end of said bolt being engageable by a socket tool of corresponding configuration of outer diameter corresponding to the effective width of said channel; said nut, upon tightening preventing removal of said projection of said second end out of said loop opening.

2. An improved lock assembly in accordance with claim 1, further characterized in said cover having a raised projection on an outer surface thereof positioned laterally of said loop opening and abutting a side edge of said second end of said hook element, to prevent dislodgement of said second end by an impact tool when said bolt is in secured condition.

* * * * *